US010480223B2

(12) United States Patent
Nakasone

(10) Patent No.: US 10,480,223 B2
(45) Date of Patent: Nov. 19, 2019

(54) LOCK DEVICE FOR OPENING AND CLOSING BODY

(71) Applicant: PIOLAX, INC., Yokohama-shi (JP)

(72) Inventor: Hisashi Nakasone, Yokohama (JP)

(73) Assignee: PIOLAX, INC., Yokohama-Shi, Kanagawa (JP)

( * ) Notice: Subject to any disclaimer, the term of this patent is extended or adjusted under 35 U.S.C. 154(b) by 0 days.

(21) Appl. No.: 15/779,809

(22) PCT Filed: Nov. 22, 2016

(86) PCT No.: PCT/JP2016/084518
§ 371 (c)(1),
(2) Date: May 29, 2018

(87) PCT Pub. No.: WO2017/094551
PCT Pub. Date: Jun. 8, 2017

(65) Prior Publication Data

US 2018/0340360 A1 Nov. 29, 2018

(30) Foreign Application Priority Data

Nov. 30, 2015 (JP) ..... 2015-233730

(51) Int. Cl.
*E05B 83/30* (2014.01)
*E05C 9/04* (2006.01)
(Continued)

(52) U.S. Cl.
CPC ..... *E05B 83/30* (2013.01); *E05B 13/10* (2013.01); *E05B 85/14* (2013.01); *E05C 9/041* (2013.01);
(Continued)

(58) Field of Classification Search
CPC ... E05B 1/04; E05B 9/04; E05B 13/10; E05B 15/00; E05B 83/00; E05B 83/28;
(Continued)

(56) References Cited

U.S. PATENT DOCUMENTS 7,048,311 B2 * 5/2006 Sawatani ..... E05B 83/30 292/32
7,455,333 B2 * 11/2008 Ookawara ..... E05B 83/30 292/34
(Continued)

FOREIGN PATENT DOCUMENTS

JP 2009-002143 A 1/2009
JP 2009-215740 A 9/2009
(Continued)

OTHER PUBLICATIONS

International Search Report (ISR) (PCT Form PCT/ISA/210), in PCT/JP2016/084518, dated Jan. 24, 2017 and English translation.
(Continued)

*Primary Examiner* — Christopher J Boswell
(74) *Attorney, Agent, or Firm* — McGinn I.P. Law Group, PLLC.

(57) ABSTRACT

A lock device includes lock portions, a pair of rods, a base member, a rotary member, and a manipulation member. The rotary member has a rod link portion coupled with the rods and transmit rotational power of the rotary member to the rods and a guide wall located inside the rod link portion in the rotary member and guides the rods. The guide wall includes arc walls or a cylindrical wall whose axis coincides with the rotation center of the rotary member. When viewed from a direction perpendicular to a bottom surface of the base member, the erection wall and the guide wall are opposed to each other with a gap. Coming-off-preventive structures for preventing the rod from coming off when the
(Continued)

rod is inserted in the gap and coupled with the rod link portion is provided between the rod and the erection wall.

19 Claims, 15 Drawing Sheets

(51) Int. Cl.
*E05B 13/10* (2006.01)
*E05B 85/14* (2014.01)
*E05C 1/14* (2006.01)

(52) U.S. Cl.
CPC ..... *E05C 9/042* (2013.01); *E05C 9/043* (2013.01); *E05C 1/145* (2013.01)

(58) Field of Classification Search
CPC . E05B 83/30; E05B 85/14; E05C 9/00; E05C 9/04; E05C 9/043
See application file for complete search history.

(56) References Cited

U.S. PATENT DOCUMENTS 7,832,239 B2 * 11/2010 Kozuka ..... E05B 83/30 292/39
8,141,398 B2 * 3/2012 Ookawara ..... E05B 83/30 292/109
8,590,351 B2 * 11/2013 Ookawara ..... E05B 83/30 292/163
9,074,389 B2 * 7/2015 Shimizu ..... E05B 83/30
9,121,206 B2 * 9/2015 Shimizu ..... E05B 63/14
9,850,691 B2 * 12/2017 Nakasone ..... E05B 83/30
2008/0290685 A1 11/2008 Ohnuki
2011/0174027 A1 7/2011 Ookawara et al.
2011/0309640 A1 * 12/2011 Matsubara ..... E05B 83/30 292/159
2015/0008680 A1 * 1/2015 Suzuki ..... E05B 83/30 292/32

FOREIGN PATENT DOCUMENTS

WO WO 2010/038716 A1 4/2010
WO WO 2015/125774 A1 8/2015

OTHER PUBLICATIONS

International Search Report (ISR) (PCT Form PCT/ISA/237), in PCT/JP2016/084518, dated Jan. 24, 2017.

* cited by examiner

LOCK DEVICE FOR OPENING AND CLOSING BODY

TECHNICAL FIELD

The present invention relates to an opening and closing body lock device for locking, in a closed state, an opening and closing body that is attached to an opening portion of a fixed body so as to be openable and closable.

BACKGROUND ART

For example, an opening and closing body such as a lid is attached to an opening portion that is formed in a fixed body such as a glove compartment of an automobile, so as to be openable and closable. And a lock device that is locked when the opening and closing body is closed and can be unlocked in opening the opening and closing body is provided between the opening portion and the opening and closing body.

For example, the following Patent document 1 discloses, as an embodiment shown in FIG. 13, a lock device of the above type which has a base member attached to an opening and closing body, a manipulation member attached to the front side of the base member, a rotor member attached to the back side of the base member, and a lock member which is slid by the rotor member. A cylindrical shaft portion projects from the rotor member at the center and a projection-shaped rotor link portion projects from the outer circumferential surface of the shaft portion. The lock member has a frame-like lock link portion in which the rotor link portion is inserted, a first extension portion which extends from the lock link portion and is to engage with and disengage from an engagement hole, and a second extension portion which extends from the lock link portion to the side opposite to the side to which the first extension portion extends. Furthermore, a pair of elastic-nail-shaped restriction portions are erected on the back side of the base member at positions that are distant from the position of the cylindrical shaft portion of the rotor member by a prescribed distance.

The lock member is pushed into the base member in a state that the lock link portion of the lock member is registered with the rotor link portion of the rotor member and the second extension portion of the lock member is set between the pair of restriction portions. As a result, the pair of restriction portions are opened, the second extension portion of the lock member is inserted between them, and nails formed at the tops of the restriction portions engage with two respective side edges of the lock member, whereby the lock member is prevented from coming off. Furthermore, the rotor link portion is inserted into the lock link portion, whereby the lock member is connected to the rotor member.

PRIOR ART DOCUMENT

Patent Document

Patent Document 1: International Publication WO 2015/125774

SUMMARY OF INVENTION

Problems to be Solved by Invention

In the above lock device, since the rotor link portion of the rotor member and the pair of restriction portions of the base member are located at different positions, when a rod is attached, as mentioned above it is necessary to position the lock link portion and the second extension portion of the lock member with respect to the rotor link portion of the rotor member and the pair of restriction portions, respectively, rendering assembling work cumbersome. Furthermore, since the pair of restriction portions for preventing the lock member from coming off are shaped like elastic nails so as to engage with two respective end portions of the rod member, at the time of assembling it is necessary to push the pair of restriction portions to open them; it is difficult to insert the rod member between the pair of restriction portions.

An object of the invention is therefore to provide an opening and closing body lock device in which rods can be attached to a rotary member easily.

Means for Solving Problems

To attain the above object, the invention provides a lock device for an opening and closing body that is attached to an opening portion of a fixed body so as to be openable and closable, the lock device comprising lock portions provided on one of the opening portion of the fixed body and the opening and closing body; a pair of rods which are provided on the other of the fixed body and the opening and closing body and are to engage with or disengage from the respective lock portions; a base member installed on the fixed body or the opening and closing body; a rotary member which is attached to the base member rotatably; and a manipulation member to manipulate the rods to engage or disengage the rods with or from the respective lock portions, wherein the base member has a bottom portion which faces an installation surface of the fixed body or the opening and closing body and has a bottom surface and a pair of erection walls which are erected from the side of the bottom surface, wherein the rotary member has a rod link portion which is coupled with the rods and transmit rotational power of the rotary member to the rods and a guide wall which is located inside the rod link portion in the rotary member and guides the rods as they slide, and the guide wall is arc walls or a cylindrical wall having arc-shaped surfaces or a circular surface whose axis coincides with the rotation center of the rotary member, wherein when viewed from a direction perpendicular to the bottom surface of the base member, each erection wall of the base member and the guide wall of the rotary member are opposed to each other with a gap capable of receiving the associated rod formed in between, and wherein coming-off-preventive structures each of which prevents the associated rod from coming off in the direction perpendicular to the bottom surface of the base member when the rod is inserted in the gap and coupled with the rod link portion is provided between the rod and the associated erection wall of the base member.

In the lock device for the opening and closing body according to the invention, it is preferable that when viewed from the direction perpendicular to the bottom surface of the base member, each erection wall of the base member and the guide wall of the rotary member be opposed to each other at least in a range of a rotation locus of the rod link portion.

In the lock device for the opening and closing body according to the invention, it is preferable that each coming-off-preventive structure comprises a bendable, elastic nail which is provided in one of the erection wall and the rod and an engagement target portion which is provided in the other of the erection wall and the rod and engages with the elastic nail, and the elastic nail engages with the engagement target portion in such a state as to urge the rod to come into contact with the guide wall.

In the lock device for the opening and closing body according to the invention, it is preferable that the erection wall of the base member be formed with the elastic nail and a side surface, opposite to a side surface located on the side of the guide wall of the base member, of the rod be formed with the engagement target portion.

In the lock device for the opening and closing body according to the invention, it is preferable that the engagement target portion be a projection strip which extends in the axial direction of the rod and is formed in the side surface, opposite to the side surface located on the side of the guide wall of the base member, of the rod at a position close to the bottom surface of the base member.

In the lock device for the opening and closing body according to the invention, it is preferable that an outer circumferential surface of the guide wall be formed with a pinion gear which serves as the rod link portion; and that the side surface, located on the side of the guide wall, of the rod be formed with rack grooves which mesh with the pinion gear.

In the lock device for the opening and closing body according to the invention, it is preferable that the rod link portions have a convex shape; and that a portion, located on the side of the bottom surface of the base member, of each rod be formed with plural recesses at prescribed intervals in a sliding direction of the rod in such a manner that the associated rod link portion can be inserted in each recess.

Advantageous Effects of Invention

In the invention, each erection wall of the base member and the guide wall of the rotary member are opposed to each other with the gap capable of receiving the associated rod formed between them. Thus, each erection wall of the base member which is part of the coming-off-preventive structure for the associated rod and the guide wall of the rotary member which guides the rod as it slides can be disposed close to each other. As a result, the rods can be attached to the rotary member easily while being prevented from coming off and guided as they slide by simple work of merely inserting the rods into the gaps between the guide wall and the erection walls and coupling the rods with the rod link portion.

EMBODIMENTS OF INVENTION

An opening and closing body lock device according to an embodiment of the present invention will be hereinafter described with reference to the drawings.

Figure 2:
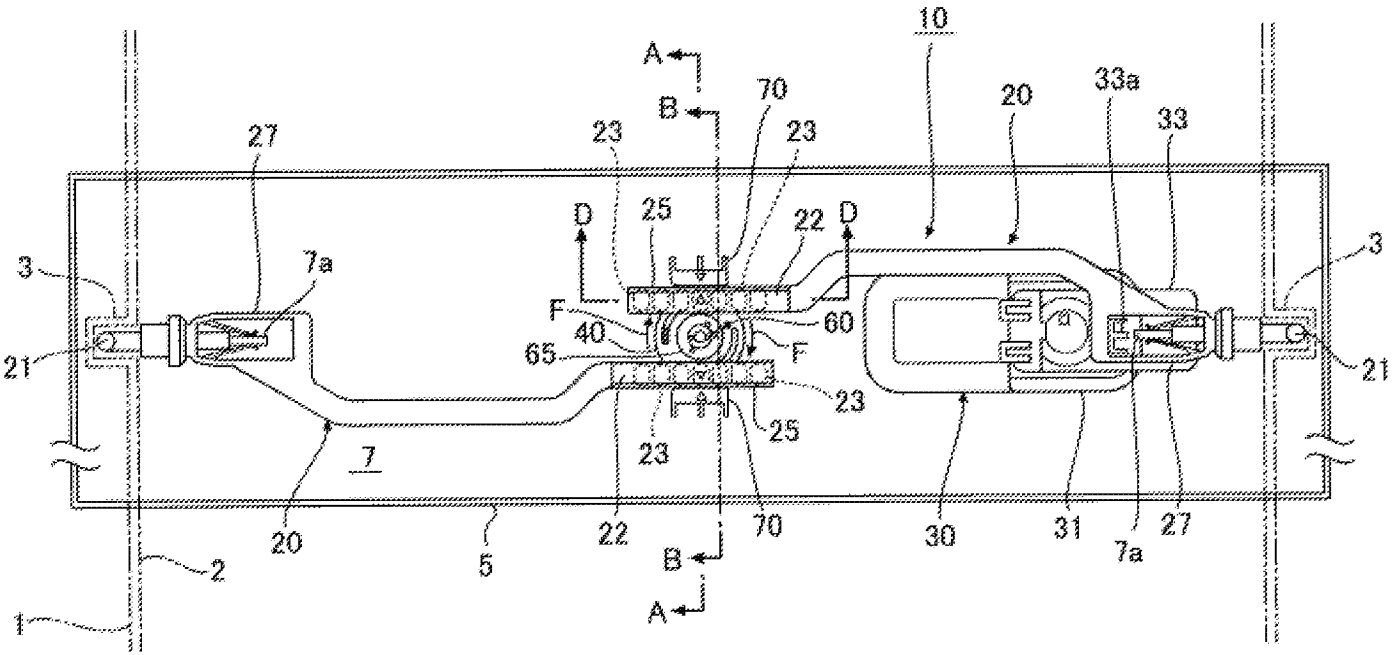
FIG. 2 is an explanatory diagram of the same lock device.

As shown in FIG. 2, an opening and closing body lock device 10 (hereinafter referred to as a "lock device 10") according to the embodiment is used for, for example, open/close-locking an opening and closing body 5 that is attached, so as to be openable and closable, to an opening portion 2 of a fixed body 1, such as a glove compartment provided in a vehicle instrument panel.

The opening and closing body lock device can be used broadly for various open/close bodies for opening and closing an opening portion of a fixed body. For example, the opening and closing body lock device can be applied to a structure in which a box-shaped glove compartment is attached to an opening portion of an instrument panel in a swingable manner (in this case, the instrument panel is a "fixed body" and the glove compartment is an "opening and closing body") and a structure in which a lid is attached to an opening portion of an instrument panel in an openable and closable manner (in this case, the instrument panel is a "fixed body" and the lid is an "opening and closing body").

As shown in FIG. 2, in this embodiment, inner surfaces of the opening 2 of the fixed body 1 is provided with two respective recess-shaped lock portions 3. The shape of each lock portion is not limited to a recess shape and may be any of a hole shape, a projection shape, a frame shape, etc. And the lock portions may be provided for the opening and closing body instead of the fixed body. The lock portions are not restricted these respects.

Figure 1:
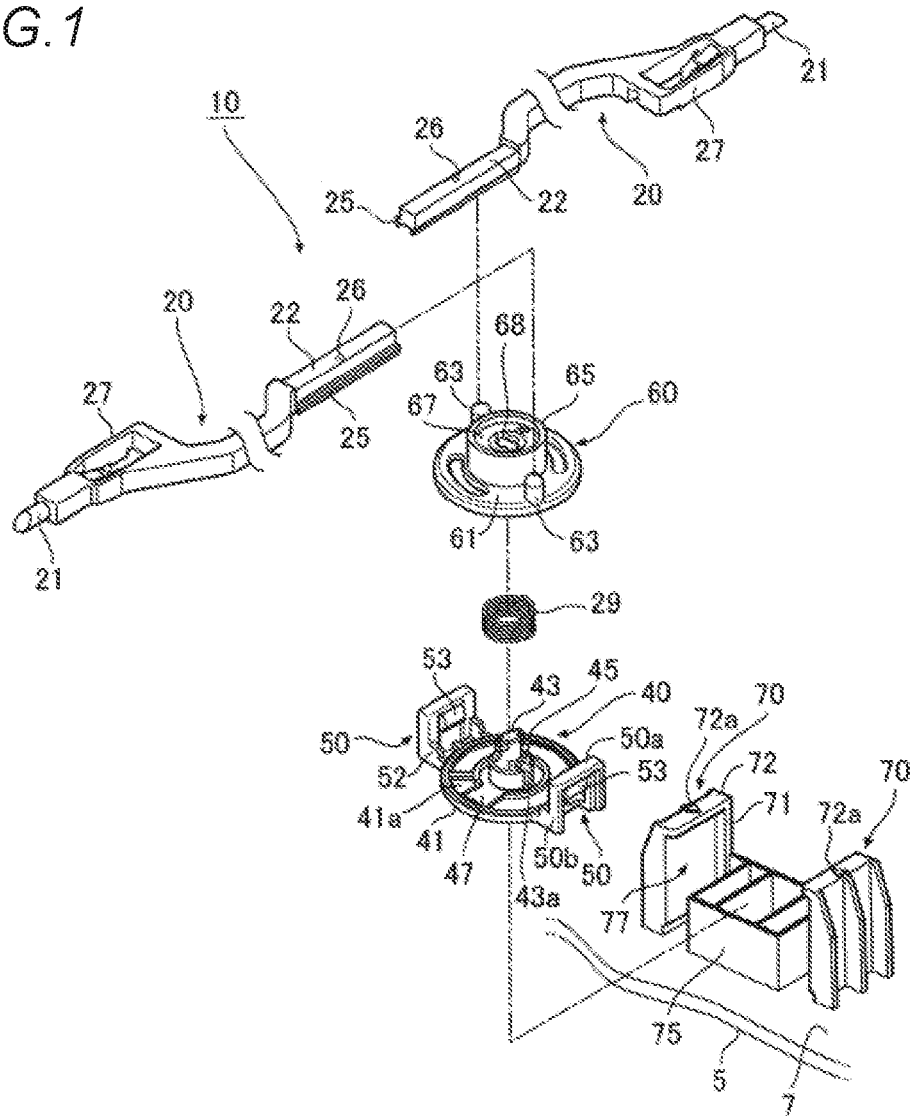
FIG. 1 is an exploded perspective view of an opening and closing body lock device according to an embodiment of the present invention.

As shown in FIGS. 1 and 2, the lock device 10 according to the embodiment is provided for the opening and closing body 5 and has a pair of rods 20 to be engaged with or disengaged from the respective lock portions 3, a base member 40 which is installed on the opening and closing body 5, a rotary member 60 which is attached to the base member 40 rotatably, and a manipulation member 30 for manipulating the rods 20 to cause them to be engaged with or disengaged from the respective lock portions 3. The lock device 10 also has an urging spring 29 which is a torsion spring and serves to urge the rotary member 60 rotationally and thereby urges the rods 20 toward the respective lock portions 3.

As shown in FIGS. 1 and 2, the opening and closing body 5 employed in the embodiment is shaped like a plate that is long in the horizontal direction and has an installation surface 7 on which the base member 40 is installed. The installation surface 7 is provided with a pair of coming-off-preventive walls 70 which hold the base member 40 on the installation surface 7 so that it does not come off the installation surface 7.

Figure 6:
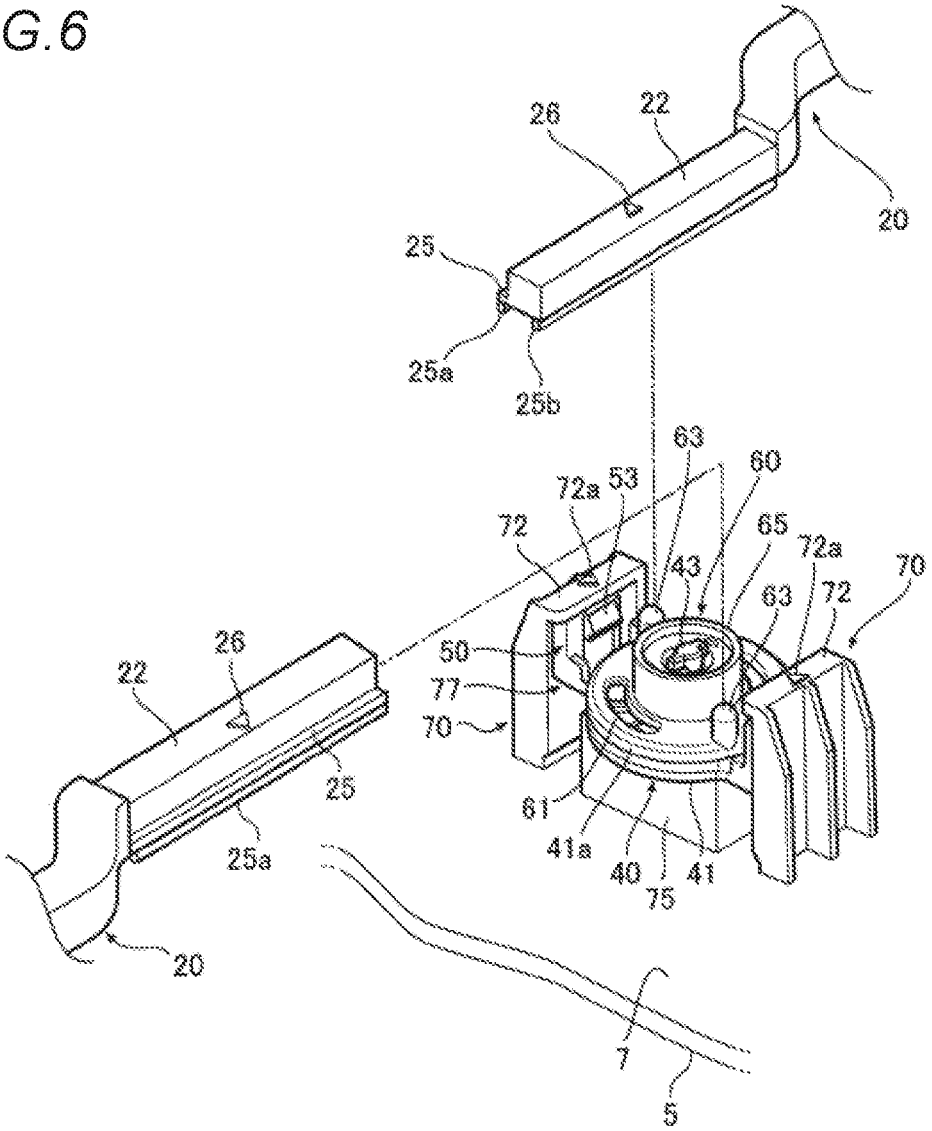
FIG. 6 is a perspective view showing how rods are attached to the rotary member in the same lock device.

Also referring to FIG. 6, the pair of coming-off-preventive walls 70 are opposed to each other parallel with each other with a prescribed interval. And a lock box 75 (see FIG. 1) which has plural circumferential walls and is open at the top and whose internal space is partitioned by plural partition walls is provided between the coming-off-preventive walls 70. The space that is surrounded by the pair of coming-off-preventive walls 70 and the lock box 75 is a receiving portion 77 which receives the base member 40 coming from a direction that crosses the direction perpendicular to the installation surface 7.

Each of the pair of coming-off-preventive walls 70 is provided with an insertion restriction portion 71 on the destination side in the base member 40 insertion direction, is formed with a ceiling portion 72 at the top end, and is recessed inside. When the base member 40 is inserted into the receiving portion 77 in the direction that crosses the direction perpendicular to the installation surface 7, erection walls 50 (described later) of the base member 40 come into contact with the respective insertion restriction portions 71, whereby the insertion of the base member 40 is restricted. At the same time, the erection walls 50 are locked on the respective ceiling portions 72, whereby the base member 40 is prevented from coming off the installation surface 7 in the direction perpendicular to it (see FIGS. 6 and 8). In addition, an elastic lock piece 47 (described later) of the base member 40 is locked on an inside portion of the lock box 75, whereby the base member 40 is prevented from coming off through the opening of the receiving portion 77.

Furthermore, an assembling mark 72*a* to serve as a reference mark at the time of attachment of the associated rod 20 is formed on the outer surface of the ceiling portion 72 of each coming-off-preventive wall 70 at a prescribed position (in this example, at the center).

The structure for preventing the base member 40 from coming off the installation surface 7 in the direction perpendicular to it or coming off through the opening of the receiving portion 77 (i.e., in the direction that crosses the direction perpendicular to the installation surface 7) is not limited to the above structure and may be any of various structures.

As shown in FIGS. 1 and 2, each of the rods 20 which have the same shape is bent like a crank at a halfway position in its axial direction. And a tip portion 21 of each rod 20 is to be engaged with or disengaged from the associated lock portion 3. A base portion 22 of each rod 20 extends a prescribed length straightly, and is formed with plural recesses 23 at prescribed intervals in a sliding direction of the rod 20 on the side of a bottom surface 41*a* of the base member 40 (see FIG. 10). Each recess 23 has an elliptical shape and is formed in such a manner that its shorter axis and longer axis extend in the longitudinal direction of the rod 20 and the direction perpendicular to the longitudinal direction, respectively (see FIG. 2). Rod link portions 63 (described later) of the rotary member 60 are inserted in and coupled with prescribed recesses 23 of the rods 20, respectively, whereby the pair of rods 20 are coupled with the rotary member 60.

Figure 7:
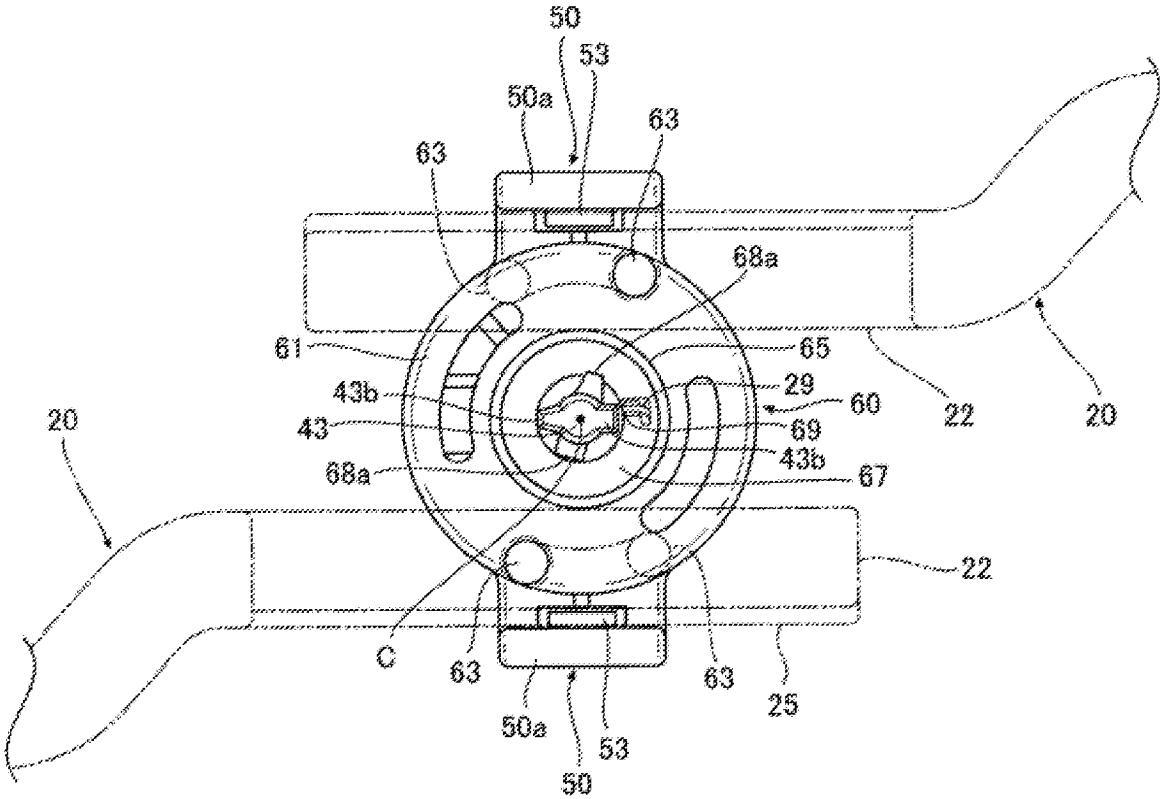
FIG. 7 is an enlarged plan view of an essential part of the same lock device.

Furthermore, as shown in FIGS. 6 and 7, the side surface, opposite to the side of contact to a guide wall 65 (described later) of the rotary member 60, of the base portion 22 of each rod 20 is formed with, at a position close to the bottom surface 41*a* of the base member 40, a projection strip 25 which projects in the axial direction of the rod 20. An elastic nail 53 (described later) of the base member 40 is engaged with the projection strip 25, whereby the rod 20 is prevented from coming off in the direction that is perpendicular to the bottom surface 41*a* of the base member 40 (see FIG. 8). That is, in the embodiment, the projection strip 25 is an "engagement target portion" of a coming-off-preventive structure of the invention.

A contact rib 25*a* projects from the projection strip 25 toward the side of the bottom surface 41*a* of the base member 40, and a contact rib 25*b* that is shaped like a projection strip projects from the bottom edge of the side surface, on the side of the guide wall 65, of the base member 40 of the rod 20 (see FIG. 6). The one contact rib 25*a* comes into contact with a rod receiving portion 52 of the base member 40 and the other contact rib 25*b* comes into contact with a base portion 61 of the rotary member 60, whereby the area of contact of the rod 20 to the base member 40 and the rotary member 60 is reduced to enhance the slidability of the rod 20 (see FIG. 8).

Furthermore, the ceiling surface, opposite to the bottom surface, the base portion 22 of each rod 20 is formed with, at a prescribed position, an assembling mark 26 to serve as a reference mark at the time of attachment of the rod 20.

Each rod 20 is formed with a frame-like portion 27 at a position close to its tip portion 21. As shown in FIG. 2, a guide projection 7*a* which projects from the installation surface 7 of the opening and closing body 5 is inserted in the frame-like portion 27 of each rod 20 and thereby guides the rod 20 when it slides. A manipulation piece 33*a* (see FIGS. 2 and 3) of the manipulation member 30 is inserted in one frame-like portion 27 to slide-manipulate the associated rod 20.

There are no particular limitations on the shape, structure, etc. of each rod. Although in the embodiment the rods 20 are provided on the opening and closing body side, they may be provided on the fixed body side.

Next, the manipulation member 30 will be described.

Figure 3:
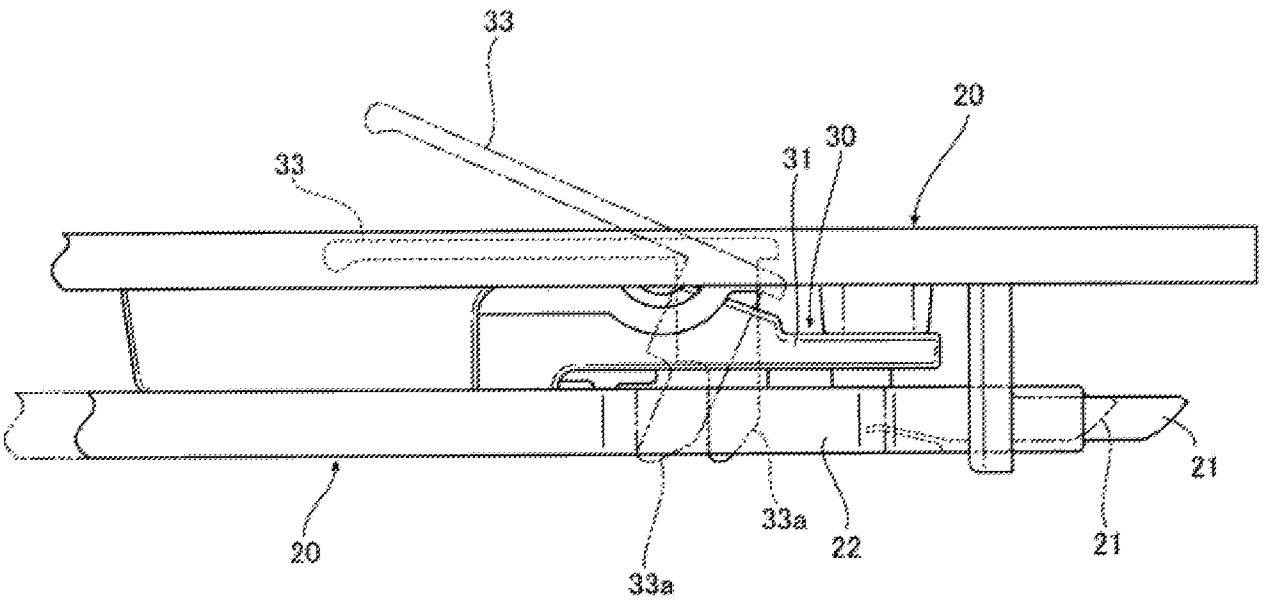
FIG. 3 is an explanatory diagram of a manipulation member of the same lock device.

As shown in FIGS. 2 and 3, the manipulation member 30 employed in the embodiment is composed of a fixed body 31 which is fixed to the opening and closing body 5 and a manipulation knob 33 which is attached to the fixed body 31 so as to be able to come closer to and go away from the surface of the opening and closing body 5. The manipulation knob 33 is provided with the manipulation piece 33*a*, which is inserted in the frame-like portion 27 of the other rod 20 to slide-manipulate the rod 20 (see FIGS. 2 and 3).

For example, the manipulation member 30 may be a rotary knob or a rotary handle that rotates parallel with the surface of the opening and closing body or the fixed body or a push-type member that is pushed perpendicularly to the surface of the opening and closing body or the fixed body. There are no particular limitations on the structure of the manipulation member 30 as long as it allows the rods 20 to be engaged with and disengaged from the respective lock portions 3. The manipulation member 30 may be attached to the fixed body side.

Next, the base member 40 will be described.

Figure 4:
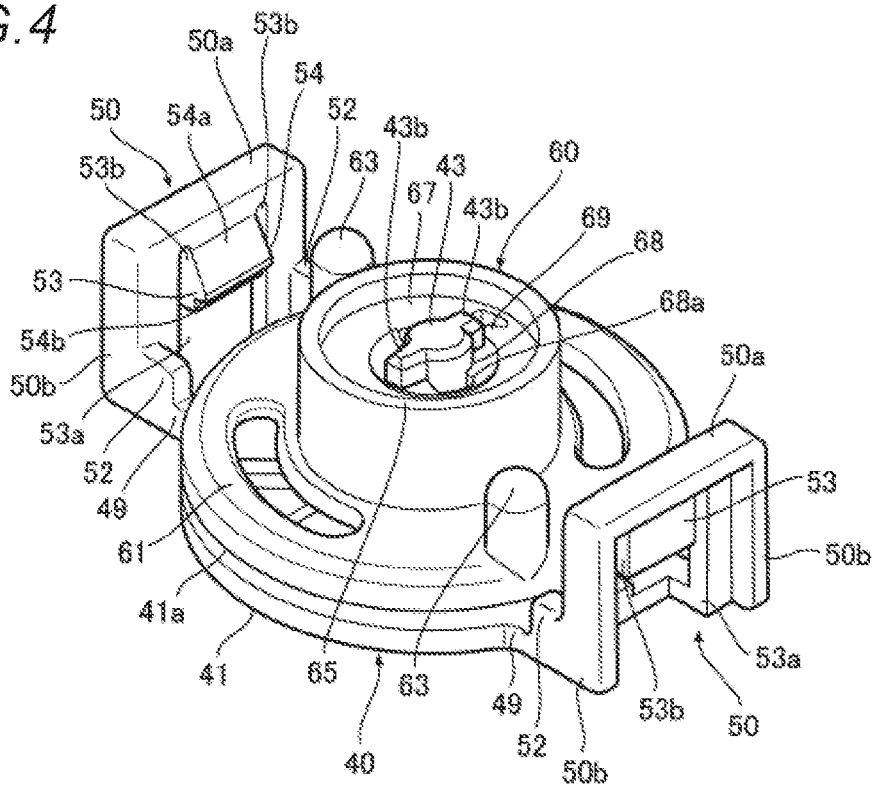
FIG. 4 is a perspective view of an assembly of a base member and a rotary member of the same lock device.
Figure 5:
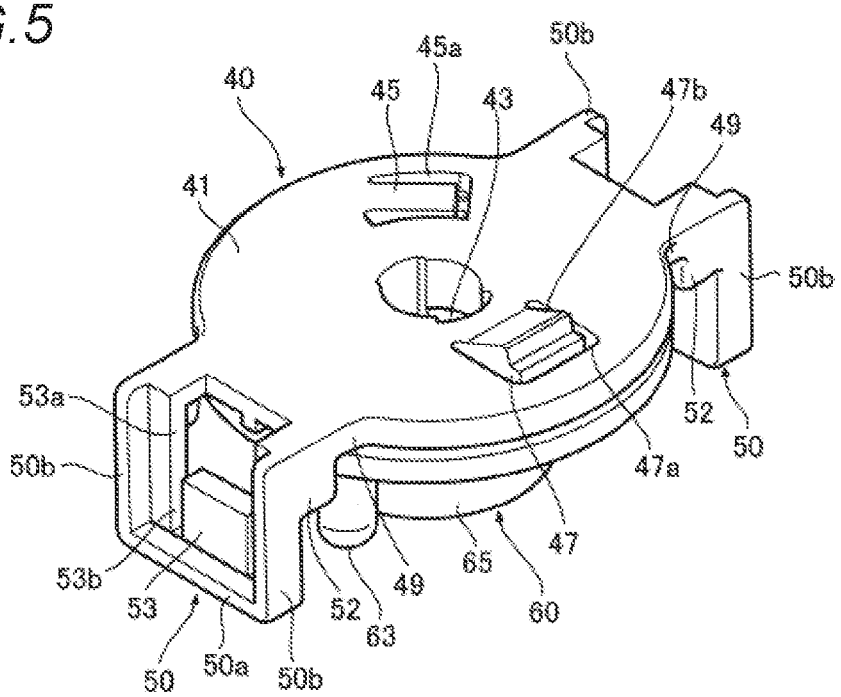
FIG. 5 is a perspective view of the assembly of the base member and the rotary member of the same lock device as viewed from a direction that is different than in FIG. 4.

As shown in FIGS. 4 and 5, the base member 40 employed in the embodiment has a bottom portion 41 which faces the installation surface 7 of the opening and closing body 5 and has the bottom surface 41*a* and the pair of erection walls 50 which are erected from the bottom surface 41*a* of the bottom portion 41.

The bottom portion 41 is generally shaped like a circular disc and its one surface is the bottom surface 41*a* on which the pair of rods 20 are mounted. A shaft portion 43 for supporting the rotary member 60 rotatably projects from the center of the bottom surface 41*a* of the bottom portion 41. A base portion of the shaft portion 43 is wider than its tip portion, and the outer circumferential surface of its base portion is formed with a spring lock groove 43*a* in which one end of the urging spring 29 is inserted and locked (see FIG. 1). A pair of projections 43*b* project from the outer circumferential surface of the tip portion of the shaft portion 43 and serve to hold the rotary member 60 so that it does not come off the base member 40.

As shown in FIG. 5, the bottom portion 41 is formed with, at a prescribed position outside the shaft portion 43, a bendable rotation restriction nail 45 (a slit 45*a* is formed around it). The rotation restriction nail 45 is locked on a prescribed portion of the rotary member 60, whereby rotation of the rotary member 60 is restricted.

As shown in FIG. 5, the bottom portion 41 is also formed with, outside the shaft portion 43 at a circumferential position that is different than the above-mentioned rotation restriction nail 45, a bendable elastic lock piece 47 (a slit 47*a* is formed around it) having a lock projection 47*b* on its outer surface. The elastic lock piece 47 is locked on an inside portion of the lock box 75, whereby the base member 40 is prevented from coming off through the opening of the receiving portion 77.

A pair of extensions 49 are formed on the outer circumferential surface of the bottom portion 41 at opposite circumferential positions, and the above-mentioned pair of erection walls 50 are erected parallel with each other from the respective extensions 49. The pair of erection walls 50 are disposed inside the above-mentioned pair of coming-off-preventive walls 70 and outside the guide wall 65 of the rotary member 60 (see FIG. 6). Furthermore, the pair of erection walls 50 are located outside the pair of rods 20 when the pair of rods 20 are coupled with the rotary member 60 (see FIG. 7).

As shown in FIG. 4, two rod receiving portions 52 shaped like rectangular pieces project at corners that are located between each extension 49 and the associated erection wall 50 (on the side of the inner surface of a base portion of the erection wall 50) and on the two respective sides in the width direction. The rods 20 are supported in such a manner that the above-mentioned contact ribs 25*a* of the rods 20 are in contact with and are supported by the respective rod receiving portions 52 (see FIG. 8).

Furthermore, the outside of each erection wall 50 is U-shaped by a ceiling portion 50*a* and a pair of side portions 50*b* and is thus open at the bottom (on the side of the bottom surface 41*a*) and the two sides. A bendable, elastic nail 53 is formed inside a frame-like portion of each erection wall 50 (a space 53*a* is formed on the side of the bottom surface 41*a* and a pair of slits 53*b* are formed around the elastic nail 53). A base portion of the elastic nail 53 is connected to the ceiling portion 50*a* of the erection wall 50 and its free end is directed to the bottom surface 41*a*.

As shown in FIG. 4, an engagement projection 54 projects as an inside portion of each elastic nail 53. The engagement projection 54 is formed with, on the side of the ceiling portion 50*a*, a slant surface 54*a* which increases the ease of attachment of the associated rod 20. The engagement projection 54 is also formed with, at a position close to the tip of the elastic nail 53, an engagement surface 54*b* to engage with the projection strip 25 of the associated rod 20 (see FIG. 8).

Figure 8:
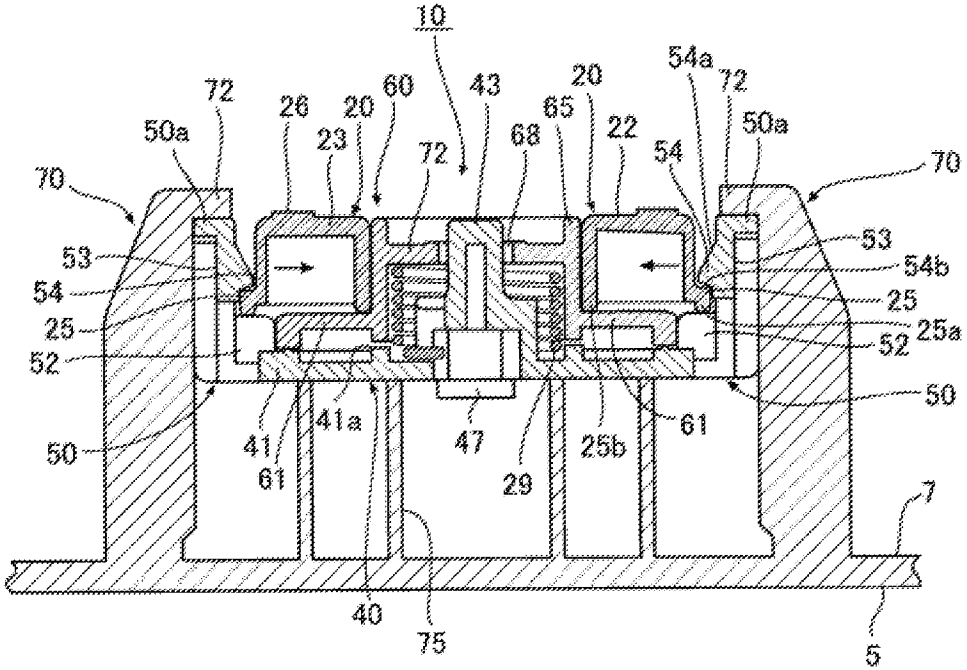
FIG. 8 is a sectional view taken along arrowed line A-A in FIG. 2.

A coming-off-preventive structure for preventing the associated rod 20 from coming off in the direction perpendicular to the bottom surface 41*a* of the base member 40 is provided between the rod 20 and the associated erection wall 50 of the base member 40. In the embodiment, as shown in FIG. 8, the engagement surface 54*b* of the above-mentioned elastic nail 53 is engaged with the projection strip 25 of the associated rod 20 and thereby prevents the rod 20 from coming off; the elastic nail 53 and the projection strip 25 which is an "engagement target portion" constitute the "coming-off-preventive structure" of the invention. The elastic nail 53 is formed so as to engage with the projection strip 25 of the associated rod 20 in a state that the rod 29 is urged so as to come into contact with the guide wall 65 of the rotary member 60 (refer to arrows shown in FIG. 8).

The "coming-off-preventive structure" is not limited to the structure comprising the above-mentioned elastic nail 53 and projection strip 25; there are no particular limitations on the "coming-off-preventive structure" as long as it can prevent the associated rod 20 from coming off in the direction perpendicular to the bottom surface of the base member. For example, a structure is possible in which an elastic nail is provided on the rod side and a projection strip or the like is provided on the side of the erection wall of the base member (this structure will be described in an embodiment to be described later).

In the invention, the base member is defined as a member that is installed on the fixed body or the opening and closing body. This includes a case that the base member is installed on the installation surface of the fixed body or the opening and closing body in such a manner as to be in contact with it, the case of the embodiment that the base member 40 is not in contact with the installation surface 7 but is spaced from the installation surface 7 with a prescribed gap (see FIG. 8), and a case that the base member is installed in such a manner that its bottom surface is located on the side opposite to the installation surface. It is meant that the base member is fixed to the installation surface so as not to be movable relative to it.

Next, the rotary member 60 will be described.

As shown in FIG. 4, the rotary member 60 employed in the embodiment has a base portion 61 which is generally shaped like a circular disc. Two rod link portions 63 which are coupled with the respective rods 20 and transmit rotational power of the rotary member 60 to the rods 20 project from an outer circumferential portion of the front surface of the base portion 61 at opposite circumferential positions.

Figure 10:
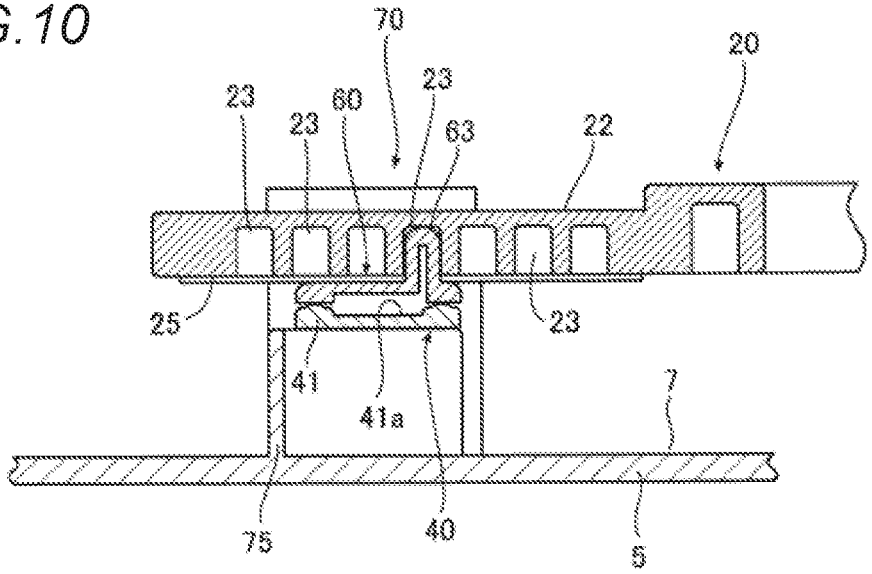
FIG. 10 is a sectional view taken along arrowed line D-D in FIG. 2.

In the embodiment, each rod link portion 63 has a convex shape, that is, it is approximately shaped like a cylinder having a round tip portion, can be inserted into and removed from a prescribed recess 23 of the associated rod 20, and does not have a structure for preventing itself from coming off in the direction perpendicular to the bottom surface 41*a* of the base member 40 (see FIG. 10). However, there are no particular limitations on the structure of each rod link portion 63. For example, it is possible that each rod link portion 63 is formed in such a manner that its tip portion is increased in diameter and shaped like a sphere, and that each rod link portion 63 is fitted in a recess 23 of the associated rod 20 so as not to come off it and the associated rod 20 is thus prevented from coming off in the direction perpendicular to the bottom surface 41*a* of the base member 40. In this case, two coming-off-preventive structures are provided, that is, this structure and the above-mentioned coming-off-preventive structure comprising the engagement surface 54*b* of the elastic nail 53 and the projection strip 25 of the associated rod 20. This provides an advantage that each rod 20 can be prevented from coming off more reliably.

Each rod link portion 63 is formed so that its outer diameter is suitable for the width of each recess 23 of each rod 20 in the longitudinal direction of the rod 20 (see FIG. 10), more specifically, so that no play exists in the longitudinal direction of the associated rod 20 and prescribed play exists in the direction perpendicular to the longitudinal direction in a state that each rod link portion 63 is inserted in a recess 23 of the rod 20.

Furthermore, the rotary member 60 has the guide wall 65 for guiding the pair of rods 20 as they slide inside the pair of rod link portions 63 in the radial direction of the rotary member 60. As shown in FIGS. 4 and 7, the guide wall 65 employed in the embodiment projects from the front surface of the base portion 61 at the center and has a cylindrical wall having circular surfaces whose axis coincides with the rotation center C (see FIG. 7) of the rotary member 60.

As shown in FIG. 7, in the lock device 10, when viewed from the direction perpendicular to the bottom surface 41*a* of the base member 40, each erection wall 50 of the base member 40 and the guide wall 65 of the rotary member 60 are opposed to each other with a gap capable of receiving the associated rod 20 formed between them. Furthermore, in the embodiment, as shown in FIG. 7, when viewed from the direction perpendicular to the bottom surface 41*a* of the base member 40, each erection wall 50 of the base member 40 and the guide wall 65 of the rotary member 60 are opposed to each other at least in a range of a rotation locus (refer to an imaginary line shown in FIG. 7) of the associated rod link portion 63.

The guide wall 65 may be a pair of arc-shaped walls that are opposed to each other, plural arc-shaped walls that are arranged in the circumferential direction, or the like; it suffices that the guide wall 65 have a circular surface or arc-shaped surfaces whose axis coincides with the rotation center of the rotary member.

A ceiling plate 67 is formed inside the guide wall 65 at a position close to its top, and an axial hole 68 having two grooves 68*a* are formed through the ceiling plate 67 at the center. The rotary member 60 is supported by the base member 40 rotatably and attached to the base member 40 in such a manner as to be prevented from coming off it by inserting the shaft portion 43 into the axial hole 68 with two projections 43*b* of the shaft portion 43 of the base member 40 registered with the two respective grooves 68*a* and then rotating the rotary member 60. There are no particular limitations on the structure for supporting the rotary member 60 rotatably; for example, the rotary member and the base member may be formed with a shaft portion and an axial hole, respectively. Furthermore, the ceiling plate 67 is formed with, adjacent to the outer circumference of the axial hole 68, a spring lock piece 69 on which the other end of the urging spring 29 is locked.

The rotary member 60 is urged by the urging spring 29 so as to rotate in the direction indicated by arrows F in FIG. 2, whereby the pair of rods 20 which are coupled with the rotary member 60 are urged in such directions as to engage with the pair of lock portions 3, respectively. The pair of rods 20 which are coupled with the rotary member 60 can slide in synchronism with each other; when one rod 20 slides, the other rod 20 also slides in linkage with the former action.

There are no particular limitations on the rotary member that allows the pair of rods to slide. An example other than the rotary member 60 employed in the embodiment is a structure in which a pinion gear is employed and each of the pair of rods is formed with rack grooves. The pinion gear is meshed with the rack grooves, whereby when one rod slides, the other rod is slid via the pinion gear. Lock devices having the rack-pinion structure will be described later in other embodiments to be described later.

Next, workings and advantages of the lock device 10 having the above configuration will be described.

First, a procedure for attaching the rotary member 60 to the base member 40 will be described. After the one end of the urging spring 29 is locked on the spring lock groove 43*a* of the base member 40 and the other end of the urging spring 29 is locked on the spring lock piece 69 of the rotary member 60, the shaft portion 43 is inserted into the axial hole 68 with the two projections 43*b* of the shaft portion 43 of the base member 40 registered with the two grooves 68*a* of the rotary member 60 against rotational urging force of the urging spring 29. As a result, the rotary member 60 is urged rotationally by the urging spring 29 and the projections 43*b* of the shaft portion 43 are located outside the axial hole 68 on its front side, whereby the rotary member 60 is attached to the base member 40 rotatably in such a manner as to be prevented from coming off it (see FIG. 4).

Subsequently, the base member 40 is inserted into the receiving portion 77 from a direction that crosses the direction perpendicular to the installation surface 7. As a result, the pair of erection walls 50 of the base member 40 are placed inside the pair of coming-off-preventive walls 70 and the ceiling portions 50*a* of the erection walls 50 are locked on the ceiling portions 72 of the coming-off-preventive walls 70, respectively, whereby the base member 40 is prevented from coming off the installation surface 7 in the direction perpendicular to it (see FIG. 8). Furthermore, the erection walls 50 of the base member 40 come into contact with the insertion restriction portions 71 of the coming-off-preventive walls 70, respectively, whereby the insertion of the base member 40 is restricted. And the lock projection 47*b* of the elastic lock piece 47 of the base member 40 is engaged with the inside of an edge of the lock box 75, whereby the base member 40 is prevented from coming off through the opening of the receiving portion 77. In this manner, the base member 40 on which the rotary member 60 is mounted is installed on the installation surface 7 of the opening and closing body 5. In this state, each erection wall 50 of the base member 40 and the guide wall 65 of the rotary member 60 are opposed to each other with the gap capable of receiving the associated rod 20 formed between them (see FIG. 7).

Then, as shown in FIG. 6, the base portions 22 of the pair of rods 20 are pushed into the gaps between the guide wall 65 of the rotary member 60 and the erection walls 50 of the base member 40 toward the bottom surface 41*a* of the base member 40 in the direction perpendicular to the bottom surface 41*a*. The rods 20 are pushed in a state that the assembling marks 26 of the rods 20 are positioned with respect to the assembling marks 72*a* of the coming-off-preventive walls 70, respectively.

Figure 9:
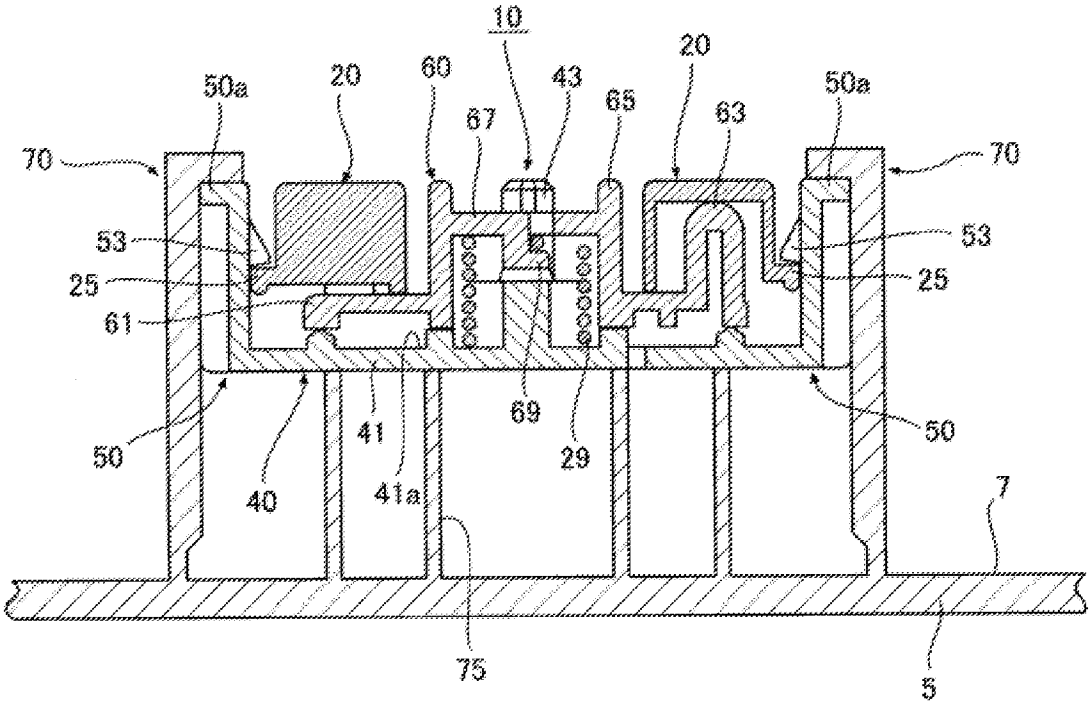
FIG. 9 is a sectional view taken along arrowed line B-B in FIG. 2.

As a result, while the rod link portions 63 are inserted into the prescribed recesses 23 of the rods 20, respectively, the slant surfaces 54*a* of the elastic nails 53 are pressed against the contact ribs 25*a* of the projection strips 25 of the rods 20, respectively, and the elastic nails 53 are bent. When the projection strips 25 thereafter go over the tops of the engagement projections 54 of the elastic nails 53 and reach the engagement surfaces 54*b*, respectively, the elastic nails 53 undergo elastic recovery, their engagement surfaces 54*b* engage with the respective projection strips 25, and urge the respective rods 20 so that they come into contact with the guide wall 65 (refer to the arrows shown in FIG. 8). Furthermore, the rod link portions 63 are inserted into the recesses 23 of the rods 20, respectively, and the tip portions of the former come into contact with the inner surfaces of the latter (see FIG. 9). In this manner, the rods 20 can be attached to the rotary member 60 in a state that the rods 20 are prevented from coming off the bottom surface 41*a* of the base member 40.

In this state, in the lock device 10, as shown in FIG. 7, each erection wall 50 of the base member 40 and the guide wall 65 of the rotary member 60 are opposed to each other with the gap capable of receiving the associated rod 20 formed between them. Thus, each erection wall 50 of the base member 40 which is part of the coming-off-preventive structure for the associated rod 20 and the guide wall 65 of the rotary member 60 which guides the rod 20 as it slides can be disposed close to each other. As a result, as described above, the rods 20 can be attached to the rotary member 60 easily while being prevented from coming off and guided as they slide by simple work of merely inserting the rods 20 into the gaps between the guide wall 65 and the erection walls 50 and coupling the rods 20 with the respective rod link portions 63.

In the embodiment, as shown in FIG. 7, when viewed from the direction perpendicular to the bottom surface 41*a* of the base member 40, each erection wall 50 of the base member 40 and the guide wall 65 of the rotary member 60 are opposed to each other at least in the range of a rotation locus (refer to the imaginary line shown in FIG. 7) of the associated rod link portion 63. Thus, each erection wall 50 and the guide wall 65 can be disposed closer to each other and work of attaching the rods 20 to the rotary member 60 can be carried out more easily.

Furthermore, in the embodiment, as shown in FIG. 8, the elastic nails 53 which are provided in the base member 40 are formed so as to engage with the respective rods 20 while urging the rods 20 so that they come into contact with the guide wall 65 of the rotary member 60. Thus, play of the rods 20 with respect to the rotary member 60 can be suppressed and abnormal sound generated by play can be reduced. In addition, the performance of guidance of the rods 20 by the guide wall 65 can be increased.

In the embodiment, the above-described elastic nails 53 are formed in the respective erection walls 50 of the base member 40 and the side surface, opposite to the side surface located on the side of the guide wall 65 of the base member 40, of each rod 20 is formed with the engagement target portion (in the embodiment, projection strip 25). Thus, the elastic nail 53 and the engagement target portion that constitute each coming-off-preventive structure can be formed within the range of the thickness of the associated rod 20 (i.e., the height of the rod 20 from its end on the side of the bottom surface 41*a* of the base member 40), whereby the lock device 10 can be made thin and hence compact.

Still further, in the embodiment, the above-described engagement target portion which is part of the coming-off-preventive structure is the projection strip 25 which is formed so as to extend in the axial direction of the associated rod 20 in the side surface, opposite to the side surface located on the side of the guide wall 65 of the base member 40, of the rod 20 at the position close to the bottom surface 41*a* of the base member 40. Thus, the bending portion of the elastic nail 53 to engage with the engagement target portion can be made long (see FIG. 8). As a result, while the lock device 10 is made thinner, the elastic nail 53 is made easier to bend to increase the ease of insertion of the associated rod 20 into the gap between the erection wall 50 and the guide wall 65.

In the embodiment, each rod 20 is formed with, on the side of the bottom surface of the base member 40, the plural recesses 23 into which the convex rod link portion 63 is to be inserted (see FIG. 10). Thus, the projection length of the tip portion 21 of each rod 20 can be changed by changing, as appropriate, the recess 23 to which the associated rod link portion 63 is inserted (i.e., the insertion position of the associated rod link portion 63; see FIG. 2). This makes it easier to use the rods 20 for plural vehicle types and hence can increase the versatility of the rods 20.

Figure 11:
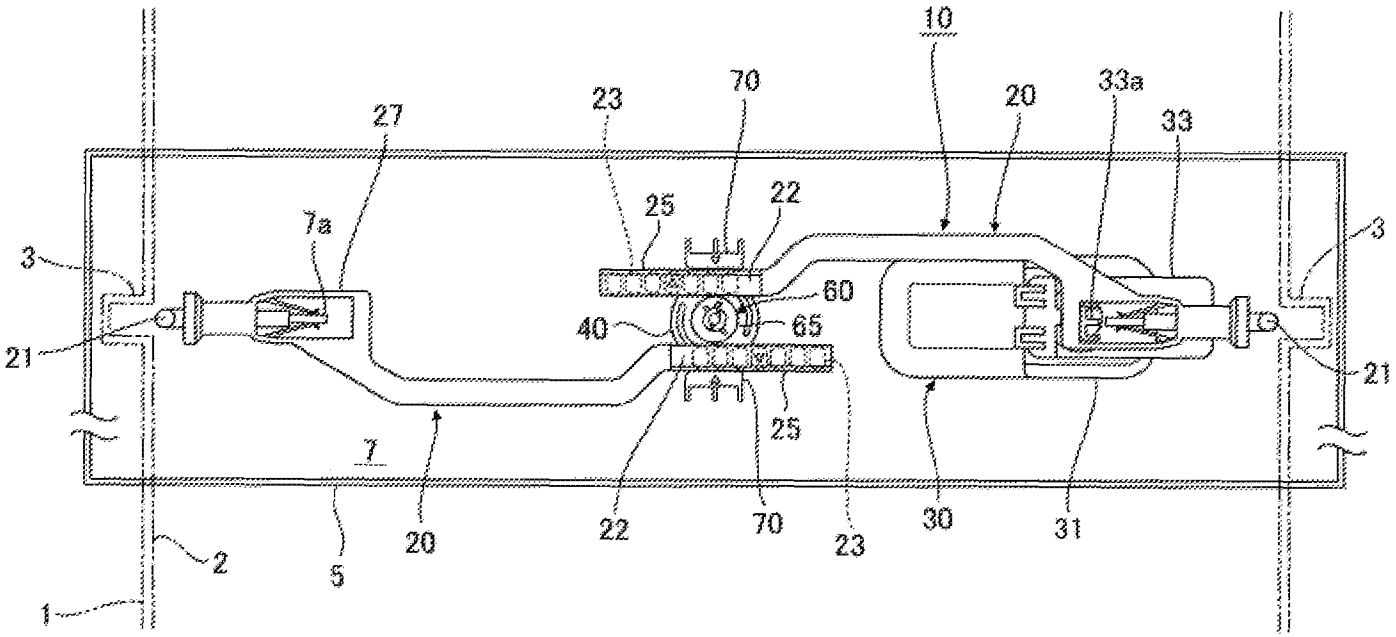
FIG. 11 is an explanatory diagram showing a state that an opening and closing body is closed.

In the lock device 10, the opening and closing body 5 is locked in a closed state when and the opening portion 2 of the fixed body 1 is closed by the opening and closing body 5 and the tip portions 21 of the pair of rods 20 are engaged with the pair of lock portions 3 of the fixed body 1, respectively (see FIG. 2). When in this state one rod 20 is pulled inward in the opening and closing body 5 via the manipulation piece 33*a* by manipulating the manipulation knob 33 of the manipulation member 30, the other rod 20 is also pulled inward in the opening and closing body 5 via the rotary member 60. As a result, the engagement between the tip portions 21 of the pair of rods 20 and the pair of lock portions 3 is canceled to make it possible to open the opening and closing body 5 from the opening portion 2 of the fixed body 1 (see FIG. 11).

FIGS. 12-15 show an opening and closing body lock device according to another embodiment of the invention. Portions, members, etc. having substantially the same ones in the above embodiment will be given the same symbols as the latter and descriptions therefor will be omitted.

Figure 12:
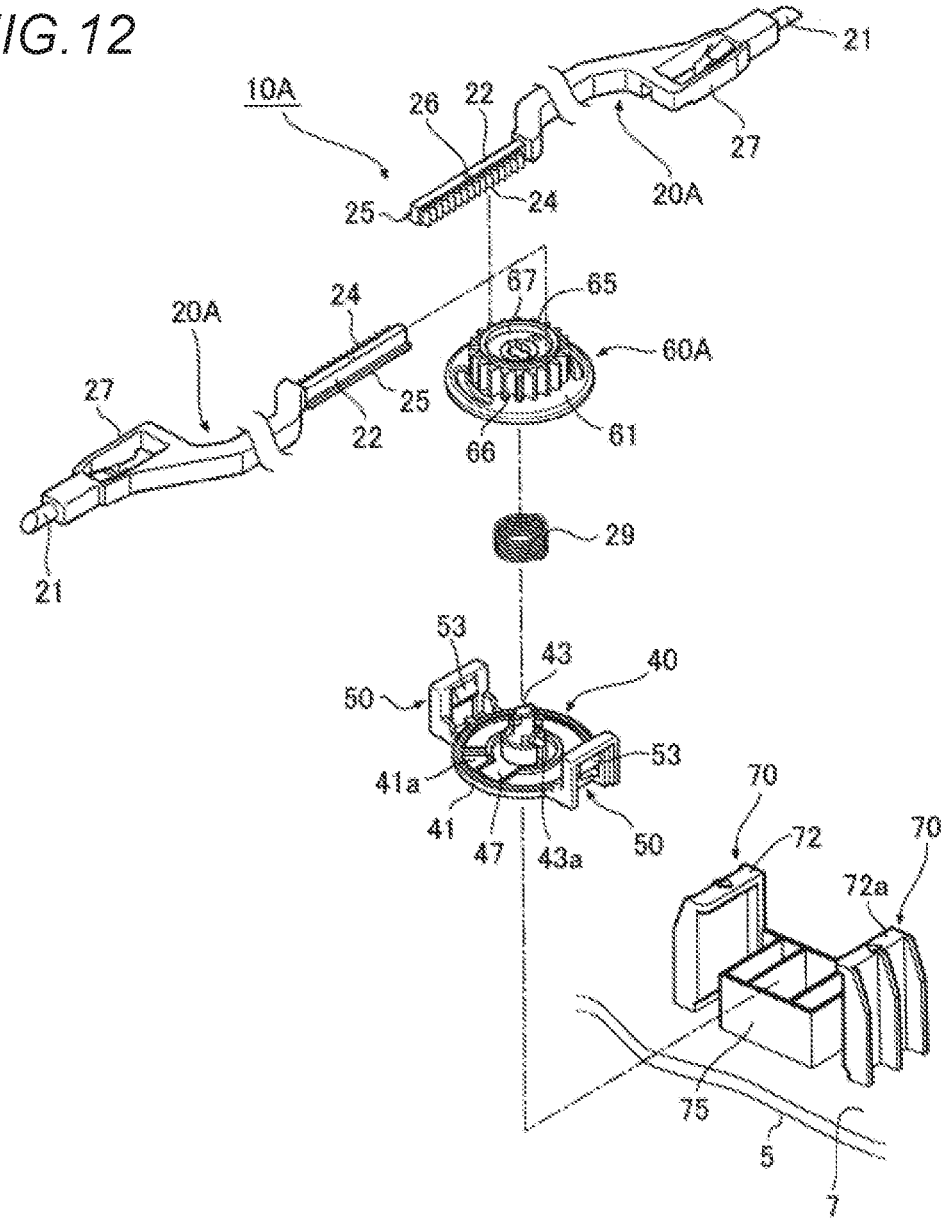
FIG. 12 is an enlarged exploded perspective view of an essential part of an opening and closing body lock device according to another embodiment of the invention.
Figure 13:
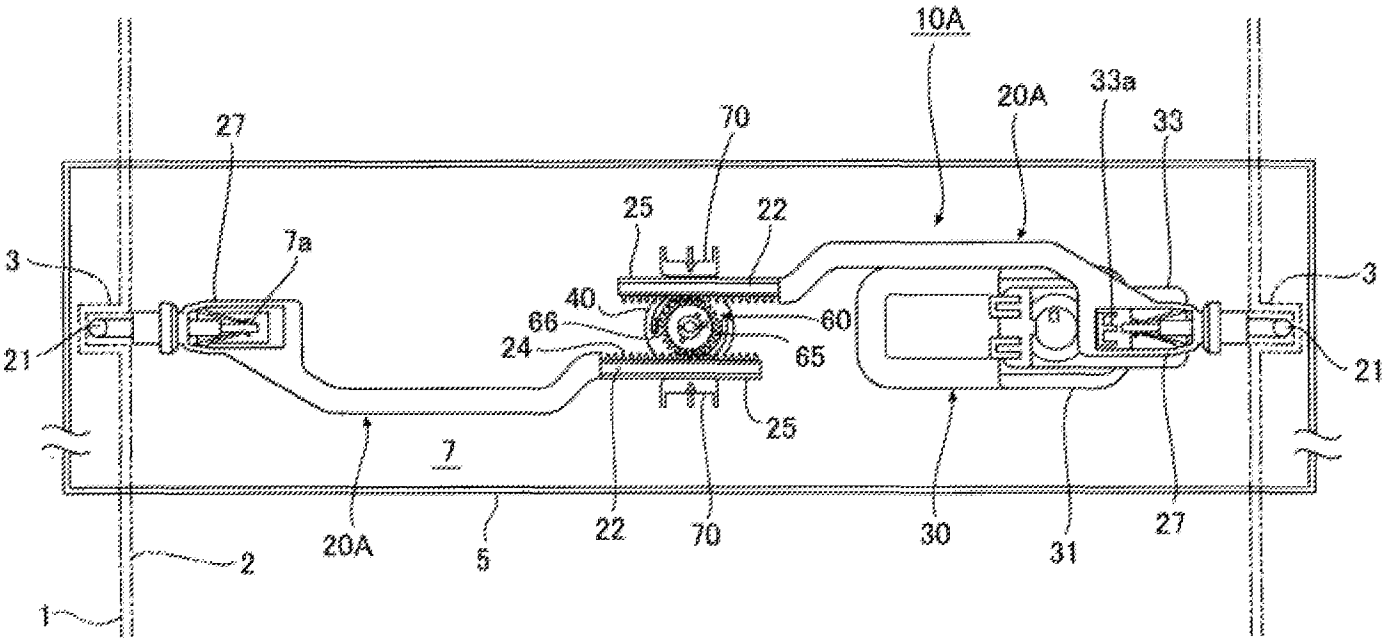
FIG. 13 is an explanatory diagram of the same lock device.

As shown in FIG. 12, the opening and closing body lock device 10A (hereinafter referred to as a "lock device 10A") according to this embodiment is different from the opening and closing body lock device according to the above embodiment in the structure for coupling a rotary member 60A with a pair of rods 20A.

Figure 14:
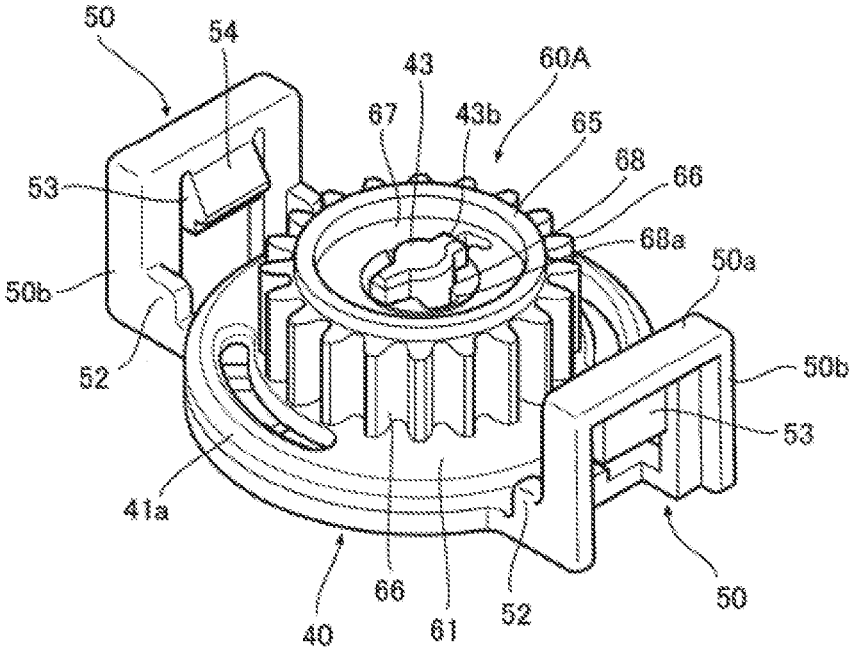
FIG. 14 is a perspective view of an assembly of a base member and a rotary member of the same lock device.

As shown in FIG. 14, the outer circumferential surface of a guide wall 65 of the rotary member 60A employed in this embodiment is formed with a pinion gear 66 which is a "rod link portion" of the invention. That is, in the rotary member 60A, the cylindrical guide wall 65 is provided inside the pinion gear 66 which is the "rod link portion." On the other hand, the surface, on the side of the guide wall 65, of a base portion 22 of each rod 20A is formed with rack grooves 24 to mesh with the above-mentioned pinion gear 66.

Figure 15:
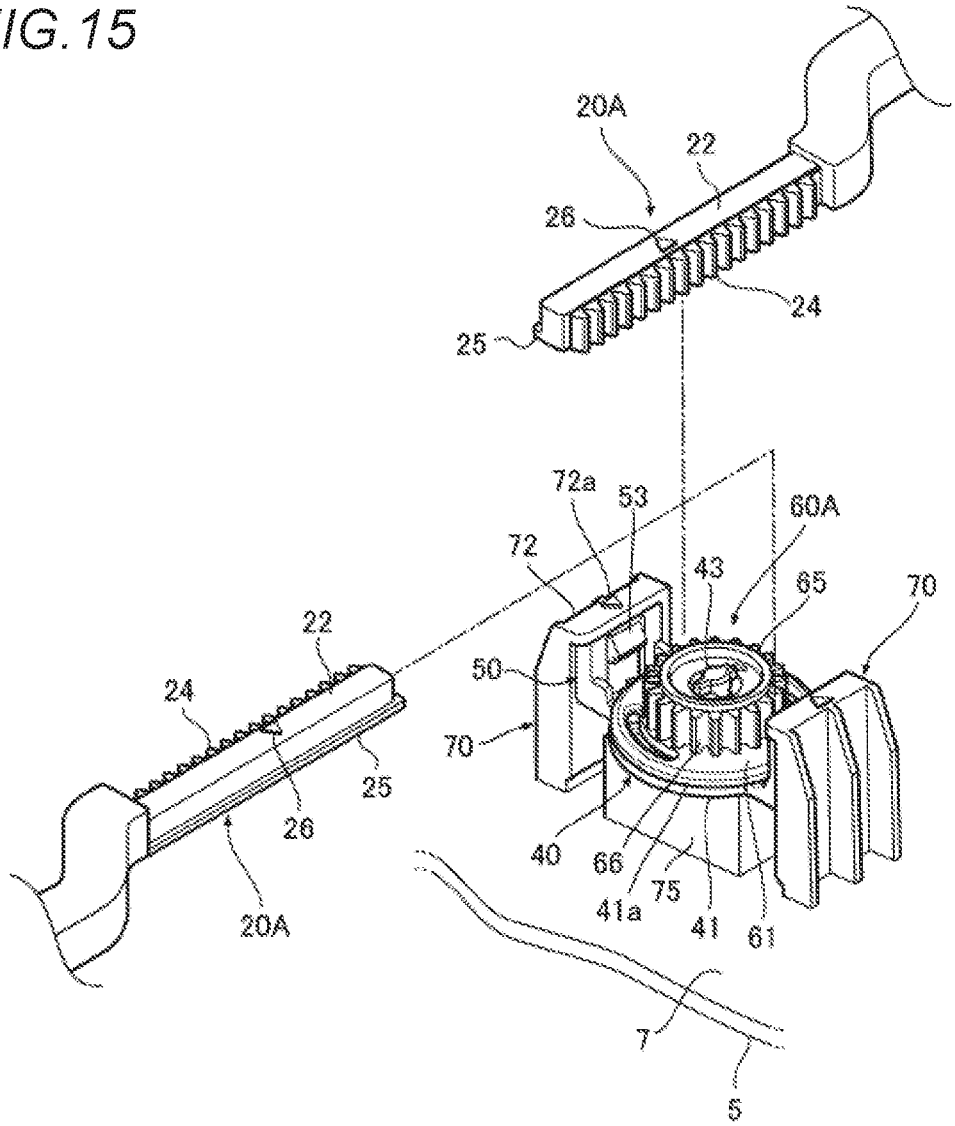
FIG. 15 is a perspective view showing how rods are attached to the rotary member in the same lock device.

In this embodiment, since the outer circumferential surface of the guide wall 65 is formed with the pinion gear 66 which is the rod link portion and the side surface, on the side of the guide wall 65, of each rod 20A is formed with the rack grooves 24, as shown in FIG. 15 the rods 20 can be inserted into the gaps between the guide wall 65 and the erection walls 50 from the direction perpendicular to the bottom surface 41*a* of the base member 40. Thus, the two sets of rack groves 24 can be meshed with the pinion gear 6 easily, the pair of rods 20 can be attached easily in synchronism with each other, and the projection lengths (projection margins), on the side of the tip portions 21, of the respective rods 20 can be adjusted easily.

In the assembled state, the rods 20A are prevented from coming off in such a manner that the elastic nails 53 of the base member 40 are engaged with the projection strips 25 of the rods 20A, respectively. Since as in the above embodiment the elastic nails 53 are engaged with the projection strips 25 in such a state as to urge the rods 20A to come into contact with the guide wall 65 of the rotary member 60A, they can absorb backlash between the pinion gear 66 and the two sets of rack grooves 24.

Figure 16:
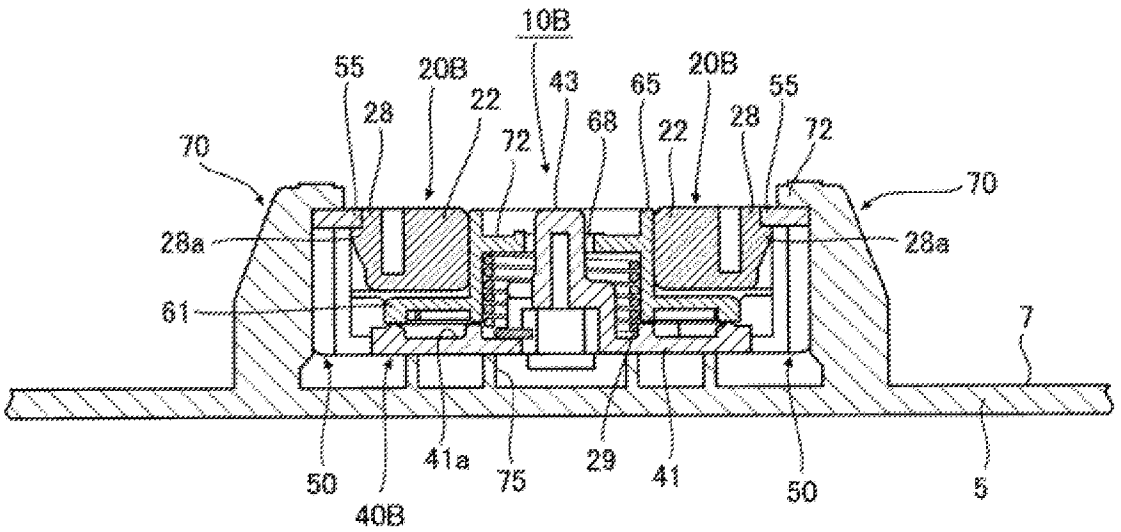
FIG. 16 is an enlarged sectional view of an essential part of an opening and closing body lock device according to a further embodiment of the invention.

FIG. 16 shows an opening and closing body lock device according to a further embodiment of the invention. Portions, members, etc. having substantially the same ones in the above embodiment will be given the same symbols as the latter and descriptions therefor will be omitted.

As shown in FIG. 16, the opening and closing body lock device (hereinafter referred to as a "lock device 10B") according to this embodiment is different than that according to the above embodiment in the structure for preventing rods 20B from coming off in the direction perpendicular to a bottom surface 41*a* of a base member 40B.

More specifically, as shown in FIG. 16, the side surface, opposite to the side surface on the side of the guide wall 65, of each rod 20B is formed with a bendable, elastic nail 28. The elastic nail 28 is formed in such a manner that its base portion is located on the side of the bottom surface of the rod 20B, its free end is located on the side of the ceiling surface of the rod 20B and an engagement projection 28*a* is located on the outer surface of the elastic mail. On the other hand, a lock wall 55 projects inward from a top end portion (i.e., an end portion opposite to the bottom surface 41*a*) of the associated erection wall 50 of the base member 40B.

The engagement projection 28*a* of the elastic nail 28 of each rod 20B engages with the associated lock wall 55 of the base member 40B, whereby the rod 20B is attached in such a state as to be prevented from coming off from the side of the bottom surface 41*a* of the base member 40B.

The invention is not limited to the above embodiments. Various modifications are possible without departing from the spirit and scope of the invention, and such modifications are also included in the scope of the invention.

BRIEF DESCRIPTION OF REFERENCE NUMERALS

1: Fixed Body
2: Opening Portion
3: Lock Portion
5: Opening and Closing Body
7: Installation Surface
10, 10A, 10B: Lock Device
20, 20A, 20B: Rod
24: Rack Grooves
25: Projection Strip
28: Elastic Nail
29: Urging Spring
30: Manipulation Member
40, 40A, 40B: Base Member
41: Bottom Portion
41*a*: Bottom Surface
43: Shaft Portion
47: Elastic Lock Piece
50: Erection Wall
53: Elastic Nail
60, 60A: Rotary Member
63: Rod Link Portion
65: Guide Wall
66: Pinion Gear
70: Coming-Off-Preventive Wall

The invention claimed is:

1. A lock device for an opening and closing body that is attached to an opening portion of a fixed body so as to be operable and closable, the lock device comprising:

lock portions provided on one of the opening portion of the fixed body and the opening and closing body;

a pair of rods which are provided on the other of the fixed body and the opening and closing body and are to engage with or disengage from the respective lock portions;

a base member installed on the fixed body or the opening and closing body;

a rotary member which is attached to the base member rotatably; and a manipulation member to manipulate the rods to engage or disengage the rods with or from the respective lock portions, wherein the base member has a bottom portion which faces an installation surface of the fixed body or the opening and closing body and has a bottom surface and a pair of erection walls which are erected from the side of the bottom surface, wherein the rotary member has a rod link portion which is coupled with the rods and transmit rotational power of the rotary member to the rods and a guide wall which is located inside the rod link portion in the rotary member and guides the rods as they slide, and the guide wall comprises arc walls or a cylindrical wall having arc-shaped surfaces or a circular surface whose axis coincides with the rotation center of the rotary member, wherein when viewed from a direction perpendicular to the bottom surface of the base member, each erection wall of the base member and the guide wall of the rotary member are opposed to each other with a gap capable of receiving the associated rod formed in between, wherein coming-off-preventive structures each of which prevents the associated rod from coming off in the direction perpendicular to the bottom surface of the base member when the rod is inserted in the gap and coupled with the rod link portion is provided between the rod and the associated erection wall of the base member, wherein each coming-off-preventive structure comprises a bendable, elastic nail which is provided in the erection wall and an engagement target portion which is provided in the rod and engages with the elastic nail, wherein each of the pair of erection walls is formed with a space which penetrates therethrough in a direction in which the pair of erection walls face each other, and wherein each of the pair of erection walls is formed into a frame-like shape surrounding the space, and the elastic nail is formed into a shape extending from the erection wall toward the space.

2. The lock device for the opening and closing body according to claim 1, wherein when viewed from the direction perpendicular to the bottom surface of the base member, each erection wall of the base member and the guide wall of the rotary member are opposed to each other at least in a range of a rotation locus of the rod link portion.

3. The lock device for the opening and closing body according to claim 1, wherein a side surface, opposite to a side surface located on the side of the guide wall of the base member, of the rod is formed with the engagement target portion.

4. The lock device for the opening and closing body according to claim 3, wherein the engagement target portion is a projection strip which extends in the axial direction of the rod and is formed in the side surface, opposite to the side surface located on the side of the guide wall of the base member, of the rod at a position close to the bottom surface of the base member.

5. The lock device for the opening and closing body according to claim 1, wherein an outer circumferential surface of the guide wall is formed with a pinion gear which serves as the rod link portion, and wherein the side surface, located on the side of the guide wall, of the rod is formed with rack grooves which mesh with the pinion gear.

6. The lock device for the opening and closing body according to claim 1, wherein the rod link portions have a convex shape, and wherein a portion, located on the side of the bottom surface of the base member, of each rod is formed with plural recesses at prescribed intervals in a sliding direction of the rod in such a manner that the associated rod link portion can be inserted in each recess.

7. The lock device for the opening and closing body according to claim 1, wherein when viewed from the direction perpendicular to the bottom surface of the base member, the elastic nail of the base member and the guide wall of the rotary member are disposed so as to be opposed to each other.

8. The lock device for the opening and closing body according to claim 1, wherein the elastic nail is formed into the shape that has a base portion disposed at a side of a tip portion of the erection wall in an erection direction thereof and a free end extending in the space from the base portion toward the bottom surface of the base member.

9. The lock device for the opening and closing body according to claim 8, wherein the elastic nail engages with the engagement target portion in such a state as to urge the rod to come into contact with the guide wall at a side of the free end thereof.

10. The lock device for the opening and closing body according to claim 1, wherein the opening and closing body includes an installation surface that is provided with the coming-off-preventive structures.

11. The lock device for the opening and closing body according to claim 10, wherein a space that is surrounded by the corning-off-preventive structures comprises a receiving portion which receives the base member coming from a direction that crosses a direction perpendicular to the installation surface.

12. The lock device for the opening and closing body according to claim 11, wherein each coming-off-preventive structure comprises an insertion restriction portion on a destination side in a base member insertion direction and is formed with a ceiling portion at a top end, and is recessed inside.

13. The lock device for the opening and closing body according to claim 12, wherein, when the base member is inserted into the receiving portion in the direction that crosses the direction perpendicular to the installation surface, the erection walls of the base member come into contact with the respective insertion restriction portions, thereby the insertion of the base member is restricted.

14. The lock device for the opening and closing body according to claim 12, wherein the erection walls are locked on the ceiling portion, thereby the base member is prevented from coming off the installation surface in the direction perpendicular to the base member.

15. The lock device for the opening and closing body according to claim 1, wherein a shaft portion for supporting the rotary member rotatably projects from the bottom portion.

16. The lock device for the opening and closing body according to claim 15, wherein a base portion of the shaft portion is wider than a tip portion, and an outer circumferential surface of the base portion is formed with a spring lock groove in which one end of an urging spring is inserted and locked.

17. A lock device for an opening and closing body that is attached to an opening portion of a fixed body so as to be operable and closable, the lock device comprising:

lock portions provided on one of the opening portion of the fixed body and the opening and closing body;

a pair of rods which are provided on the other of the fixed body and the opening and closing body and are to engage with or disengage from the respective lock portions;

a base member installed on the fixed body or the opening and closing body;

a rotary member which is attached to the base member rotatably; and a manipulation member to manipulate the rods to engage or disengage the rods with or from the respective lock portions, wherein the base member has a bottom portion which faces an installation surface of the fixed body or the opening and closing body and has a bottom surface and a pair of erection walls which are erected from the side of the bottom surface, wherein the rotary member has a rod link portion which is coupled with the rods and transmit rotational power of the rotary member to the rods and a guide wall which is located inside the rod link portion in the rotary member and guides the rods as they slide, and the guide wall comprises arc walls or a cylindrical wall having arc-shaped surfaces or a circular surface whose axis coincides with the rotation center of the rotary member, wherein when viewed from a direction perpendicular to the bottom surface of the base member, each erection wall of the base member and the guide wall of the rotary member are opposed to each other with a gap capable of receiving the associated rod formed in between, wherein coming-off-preventive structures each of which prevents the associated rod from coming off in the direction perpendicular to the bottom surface of the base member when the rod is inserted in the gap and coupled with the rod link portion is provided between the rod and the associated erection wall of the base member, wherein each coming-off-preventive structure comprises a bendable, elastic nail which is provided in the erection wall and an engagement target portion which is provided in the rod and engages with the elastic nail, and wherein the erection wall is formed with a pair of slits, and the elastic nail is formed in the erection wall in a bendable manner through the pair of slits.

18. The lock device for the opening and closing body according to claim 17, wherein when viewed from the direction perpendicular to the bottom surface of the base member, a width of the erection wall is less than a width of the bottom surface of the base member and a width of the elastic nail is less than a width of the erection wall.

19. A lock device for an opening and closing body that is attached to an opening portion of a fixed body so as to be openable and closable, the lock device comprising:

lock portions provided on one of the opening portion of the fixed body and the opening and closing body;

a pair of rods which are provided on the other of the fixed body and the opening and closing body and are to engage with or disengage from the respective lock portions;

a base member installed on the fixed body or the opening and closing body;

a rotary member which is attached to the base member rotatably; and a manipulation member to manipulate the rods to engage or disengage the rods with or from the respective lock portions, wherein the base member has a bottom portion which faces an installation surface of the fixed body or the opening and closing body and has a bottom surface and a pair of erection walls which are erected from the side of the bottom surface, wherein the rotary member has a rod link portion which is coupled with the rods and transmit rotational power of the rotary member to the rods and a guide wall which is located inside the rod link portion in the rotary member and guides the rods as they slide, and the guide wall comprises arc walls or a cylindrical wall having arc-shaped surfaces or a circular surface whose axis coincides with the rotation center of the rotary member, wherein when viewed from a direction perpendicular to the bottom surface of the base member, each erection wall of the base member and the guide wall of the rotary member are opposed to each other with a gap capable of receiving the associated rod formed in between, wherein coming-off-preventive structures each of which prevents the associated rod from coming off in the direction perpendicular to the bottom surface of the base member when the rod is inserted in the gap and coupled with the rod link portion is provided between the rod and the associated erection wall of the base member, wherein each coming-off-preventive structure comprises a bendable, elastic nail which is provided in the erection wall and an engagement target portion which is provided in the rod and engages with the elastic nail, and the elastic nail is thrilled into a shape having a base portion disposed at a side of a tip portion of the erection wall in an erection direction thereof and a free end extending from the base portion toward the bottom surface of the base member, wherein a side surface, opposite to a side surface located on the side of the guide wall of the base member, of the rod is formed with the engagement target portion, wherein the engagement target portion is a projection strip which extends in the axial direction of the rod and is formed in the side surface, opposite to the side surface located on the side of the guide wall of the base member, of the rod at a position close to the bottom surface of the base member, and wherein the elastic nail has an engagement surface which engages with an upper surface of the projection strip to prevent the rod from corning-off, and the elastic nail engages with the engagement target portion in such a state that a tip of the free end of the elastic nail urges a side surface of the projection strip so that the rod comes into contact with the guide wall.

* * * * *